US006086159A

United States Patent [19]

Peterson

[11] Patent Number: 6,086,159

[45] Date of Patent: Jul. 11, 2000

[54] SOFTWALL MINING METHOD AND DEVICE

[75] Inventor: Randall D. Peterson, Sandy, Utah

[73] Assignee: IMC-Agrico MP, Inc., Northbrook, Ill.

[21] Appl. No.: 09/287,885

[22] Filed: Apr. 7, 1999

Related U.S. Application Data

[63] Continuation-in-part of application No. 08/851,680, May 6, 1997, abandoned.

[51] Int. Cl.[7] ..... E21C 27/18

[52] U.S. Cl. ..... 299/17; 299/32; 299/33

[58] Field of Search ..... 299/17, 31, 32, 299/33

[56] References Cited

U.S. PATENT DOCUMENTS

| | | | |
|---|---|---|---|
| 3,790,214 | 2/1974 | Kilroy | 299/8 |
| 4,017,122 | 4/1977 | Simpson | 299/11 |
| 4,243,268 | 1/1981 | Lobbe et al. | 299/32 |

FOREIGN PATENT DOCUMENTS

| | | | |
|---|---|---|---|
| 2929153 | 11/1981 | Germany | 299/17 |
| 3319662 | 12/1984 | Germany | 299/17 |
| 2307413 | 3/1994 | Germany . | |
| 1122820 | 11/1984 | U.S.S.R. | 299/17 |
| 1652540 | 5/1991 | U.S.S.R. | 299/32 |

OTHER PUBLICATIONS

NASA, "Automated Coal–Mining System," NTIS Tech Notes, Jan. 1986, Virginia, USA, XP002068425, pp. 71–72.

*Primary Examiner*—Eileen Dunn Lillis
*Assistant Examiner*—Sunil Singh
*Attorney, Agent, or Firm*—Antonio R. Durando

[57] ABSTRACT

Slurryable ore where the overburden is unstable and subject to collapse is mined from substantially parallel elongated main trenches connected by a perpendicular trench at the bottom of the mineral seam. A plurality of softwall mining devices supported by face equipment is placed in the perpendicular trench. The devices slurry the mineral material and move into the mineral seam as the overburden sloughs behind the mining devices. The subsided overburden is supplemented as necessary with injected material. Slurried mineral flows to the parallel trenches for removal to the surface. After the softwall devices have advanced the length of the parallel trenches, the devices are withdrawn and placed in additionally developed trenches elsewhere in the ore reserve.

22 Claims, 10 Drawing Sheets

SOFTWALL MINING METHOD AND DEVICE

RELATED APPLICATIONS

This application is a continuation-in-part application of U.S. Ser. No. 08/851,680, filed by the same inventor on May 6, 1997, now abandoned.

BACKGROUND OF THE INVENTION

1. Field of the Invention

This invention pertains in general to the field of mining and, in particular, to a novel device and method for mining slurryable, shallow mineral deposits with earthy overburden in a longwall fashion.

2. Description of the Prior Art

Surface mining is and has historically been employed to recover stratified minerals under overburden to economic depths. Underground mining is traditionally employed when overburden depths exceed those economically removable by surface mining or when major surface disturbance is unacceptable.

Prior inventions have been patented for longwall mining of reserves using trenched entry where overburden is sufficiently competent to bridge over longwall shearing and conveying equipment and where floor strata are competent to withstand mining stresses. (See Simpson, U.S. Pat. No. 4,017,122.) Simpson does not accommodate soft, plastic, fluid, loose, unstable, clayey, sandy, dirt, soil, or similar (earthy) ground conditions often encountered in mining shallow ore deposits. Earthy conditions can allow the mine roof to fall ahead of shield supports or allow the floor to heave up behind the face conveyor ahead of the shield pontoons. This creates safety hazards, dilution of ores, and expensive control installation.

The present invention provides a means for mining slurryable ore reserves where overburden is earthy. Floor conditions are also reduced to being an insignificant issue.

BRIEF SUMMARY OF THE INVENTION

The idea of adapting longwall mining equipment and methods to recover ore from slurryable deposits with earthy overburden is novel. The term "softwall" is a new term applicable to this type of mining.

In particular, the subject invention is directed at phosphate matrix mining. A plurality of elongated, substantially parallel, main trenches extend the full length of area to be mined. The trenches are nominally 1,000 feet apart. Heading trenches substantially perpendicular to the main panel trenches are excavated for placement and removal of the mining equipment. The trenches are formed by excavating the overburden materials to the top surface of the mineral bed. The mineral bed in the trench is separately excavated and beneficially recovered. Trench side wall slopes are as steep as is geologically reasonable and safe to minimize excavation.

Forming a header trench leaves an exposed longwall. The softwall mining equipment is installed in the header trench. The phosphate is then mined, for example, by slurrying the ore as the mining equipment moves in a direction generally parallel to the main panel trenches. The slurried ore flows into the main panel trenches where it is removed to the surface for processing.

The softwall mining equipment includes an outer shell to support the overburden stresses. Forward motion is created by extending a cutting head into the ore reserve and retracting said head in such a manner as to pull the outer shell forward.

Unsupported overburden behind the outer shell is encouraged to fill the cavity. Where backfilling is used, materials are injected through the outer shell. Operation of the softwall equipment and backfilling is performed automatically from controls in the trench or on the surface.

When softwall mining equipment has traveled a predetermined distance to the next header trench, the equipment is removed and placed in another header trench for mining additional ore. Trenches not scheduled for further use would be reclaimed.

Alternatively, the equipment can be repositioned at the exit header and again advanced in the opposite direction to mine the next lower level of the ore seam.

Another alternative would be to utilize several sets of softwall mining equipment in a seam thicker than one set of equipment can mine. The uppermost level would be mined first. Adjacent lower levels would be mined with predetermined horizontal separation distances between sets of equipment.

Yet another alternative, where ore can be slumped, is to position the softwall mining equipment at or near the bottom of the ore seam, With or without forward injection of fluids into the ore seam, the slurried ore would slump into the softwall mining equipment and move into the main panel trenches.

Instead of using parallel main panel trenches and a common header trench, a single main trench can be used with a header constructed in a "T" manner. One set of softwall mining equipment would be placed in each header branch of the "T" with slurried ore feed to the trunk main panel trench.

The equipment can also operate in a spiral fashion following main panel trenches constructed to curl in a continuous pattern through the ore reserve.

Besides the objects and advantages described above, the softwall mining device of the present invention is also believed:

a. to provide a more economical means of mining slurryable ores;

b. to provide a means of removing areas by longwall methods under earthy overburden:

c. to provide a means of longwall mining without use of panel development and outbye roof support;

d. to provide an alternative means of mining sticky clay ore; and e. to provide a means of mining material varying from solid to liquid phases without special concern for the phase.

DESCRIPTION OF THE PREFERRED EMBODIMENTS OF THE INVENTION

Figure 1:
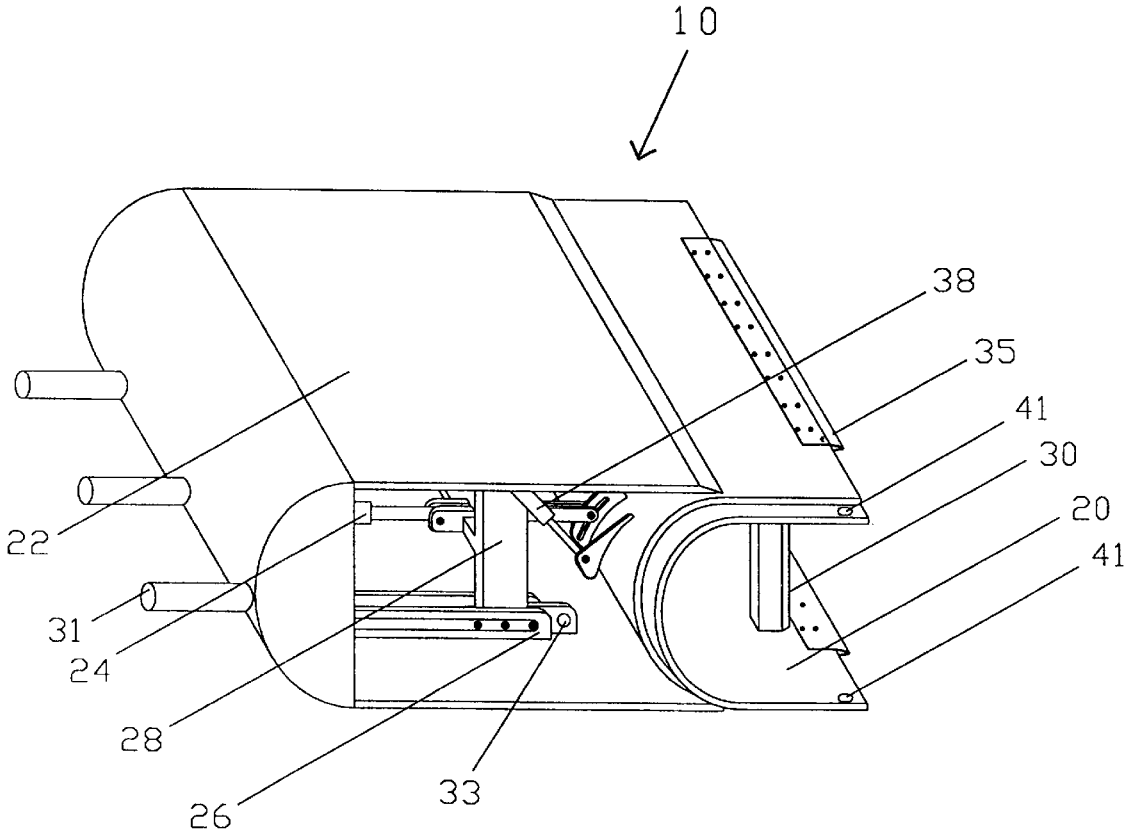
FIG. 1 shows an isometric view of a softwall mining device according to the invention.

A typical embodiment of the softwall mining equipment of the invention is illustrated in FIGS. 1 through 4. FIG. 1 is an isometric schematic view of a softwall mining device 10 according to the invention. The device 10 consists of a face sluicing chamber 20 partially enclosed within a rear and rear bearing support or shell 22. The function of the device 10 is to remove ore matrix away from the ore face. This is accomplished by the forward extension of the face sluicing chamber 20 from within the rear bearing support 22 through the actuation of an extension ram 24. Forward movement is enhanced by the action of a plurality of cutting edge injection nozzles 35 mounted on the face sluicing chamber 20, as also seen in detail in FIG. 4A. Elongated slots 41 are provided to movably join the tongue and grooved edges of the face sluicing chamber 20 together with other softwall mining devices.

Rigidly mounted on the rear bearing support 22, extension guides 26 provide directional thrust control for the device's forward movement. A plurality of rigidly mounted support braces 30 provide vertical strength to the face sluicing chamber 20. A retractable and extendable rotating ram or guide 38, pivotally mounted to both the face sluicing chamber 20 and the extension and support assembly 28, provides vertical movement control. A plurality of rear injectors 31 extend through the rear bearing support 22 to apply fluids into the collapsed overburden.

Figure 2:
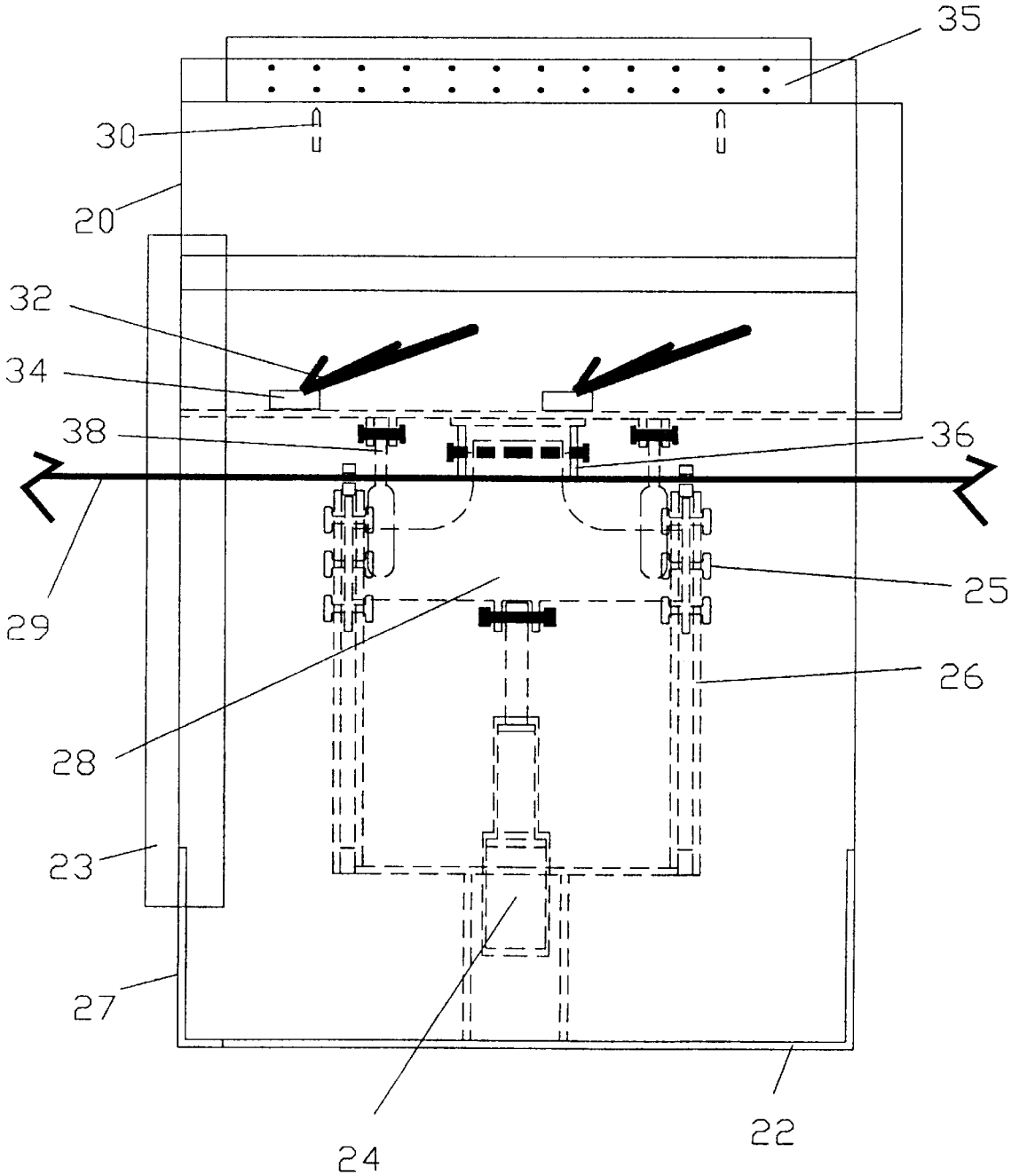
FIG. 2 shows a plan or top view of the softwall mining device of the invention.

FIG. 2 shows the softwall mining device 10 in plan view. The extension and retraction of the face sluicing chamber 20 from the rear bearing support 22 is provided by the extension ram 24 attached fixedly to the rear bearing support 22 and pivotally to the extension and support assembly 28. The extension and support assembly 28 is attached slidingly to both extension guides 26 by means of a plurality of extension and support guide bearing assemblies 25 and directly to the inclined rotating ram 38.

A plurality of pressurized water supply lines and electrical controls 21 (FIG. 3) and water injection control units 34 are attached to face sluicing chamber 20 to provide control of injection fluid pressure and volume. A plurality of pressurized, preferably angularly mounted, injection nozzles 32 fed from each water injection control unit 34 is mounted on the face sluicing chamber 20 to supply fluid injection within the enclosure of the face sluicing chamber 20.

Figure 3:
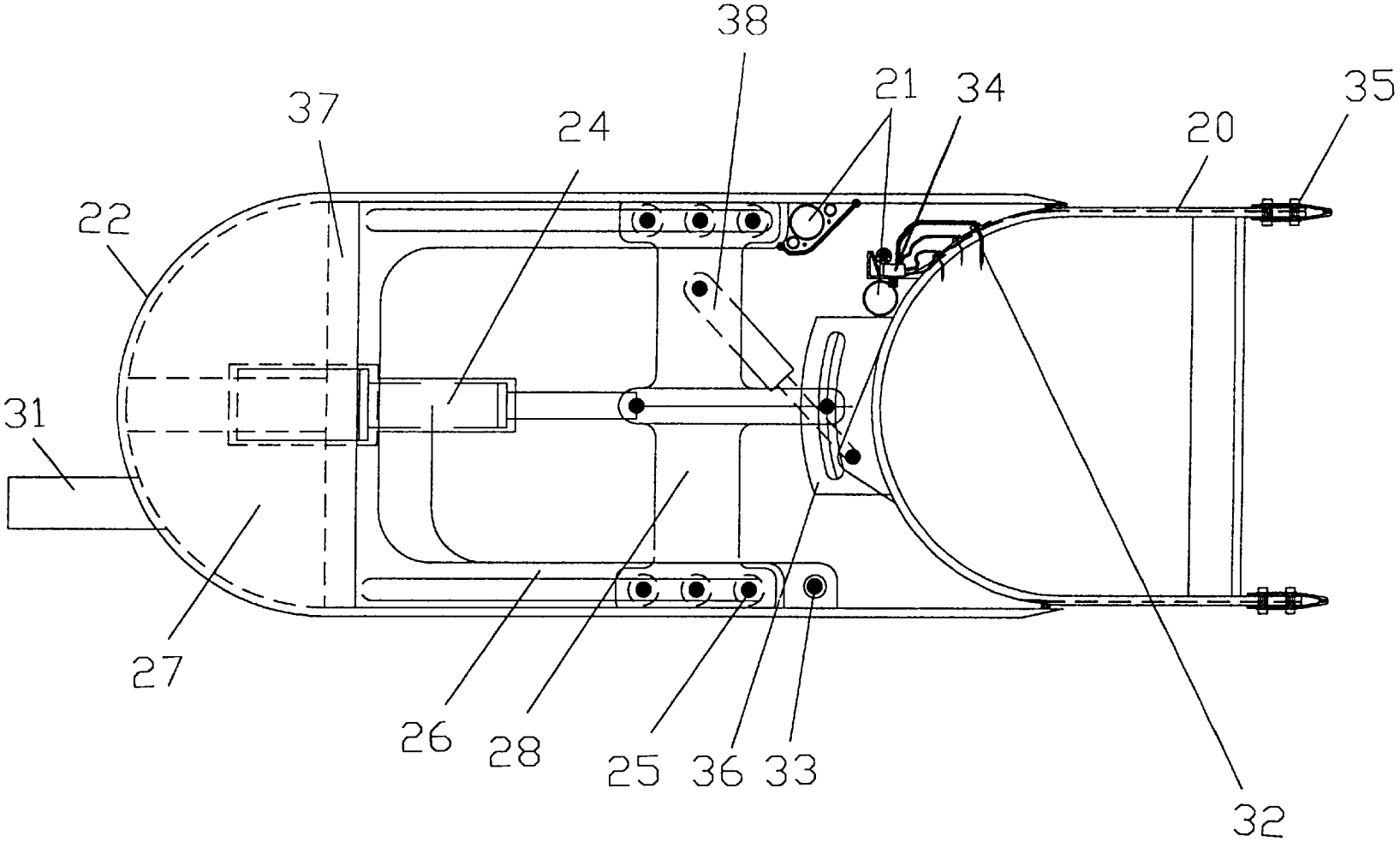
FIG. 3 shows an end view of the softwall mining device of FIGS. 1 and 2.

FIG. 3 is a schematic representation of the cross section of the mining equipment 10. The leading edge of a rear bearing support 22 is typically beveled to reduce forward resistance. The inclined rotating guide 38 is fixedly connected to the rear portion of the face sluicing chamber 20. A rigid support post 37 is rigidly mounted to the floor and roof of the rear bearing support 22 for strengthening the device. A softwall system control line alignment hole 33 is provided in the extension guides 28. Overlapping side covers 27 are rigidly connected to the rear bearing support 22 to reduce the likelihood of foreign materials entering the device when used in combination with other softwall mining devices.

Figure 4A:
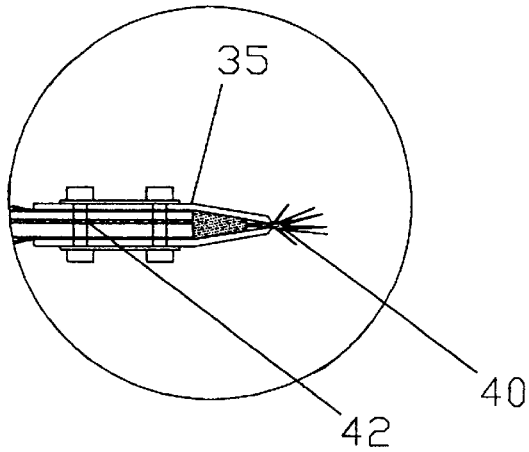
FIG. 4A shows a more detailed view of the top portion of the cutting head seen in FIG. 4.
Figure 4:
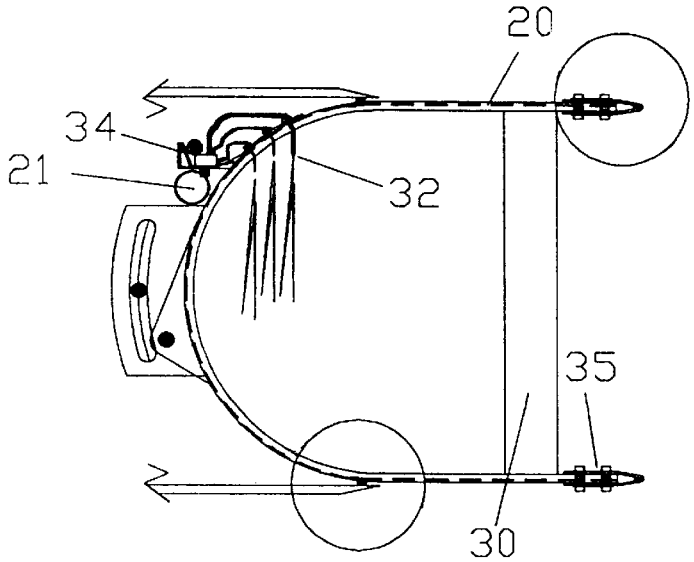
FIG. 4 shows an end view of the cutting head of the face sluicing chamber.
Figure 4B:
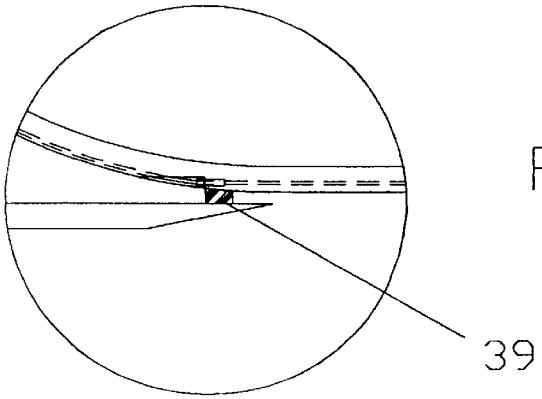
FIG. 4B shows a more detailed view of the bottom portion of the cutting head seen in FIG. 4.

FIG. 4 shows a more detailed side view of the face sluicing chamber 20, with enlarged details shown in FIGS. 4A and 4B. Pressurized injection fluid is delivered to the plurality of water injection control units 34 through the series of pressurized water supply lines and electrical controls 21. The water injection control units 34 are mounted on the outside surface of the face sluicing chamber 20 and distribute pressurized injection fluids to the respective pressurized injection nozzles 32 inside the face sluicing chamber 20. A plurality of nozzles 32 is mounted inside the face sluicing chamber 20 to inject fluids into the ore to break ore from its insitu condition and create a slurry. The face sluicing chamber 20 is preferably machined with a channel inner plate water conduit 42 (FIG. 4A) to provide a conduit for injection fluids to travel from the water injection control units 34 to a penetrating edge orifice 40, where the fluids are injected through multiple cutting-edge injection nozzles 35. The cutting-edge injection nozzles 35 are mounted rigidly on the leading edge of the face sluicing chamber 20 to inject fluids into the ore matrix to aid in penetration. A face sluicing chamber seal 39 (FIG. 4B) provides a seat to prevent external materials from entering the enclosure of the rear bearing support 22.

Figure 4C:
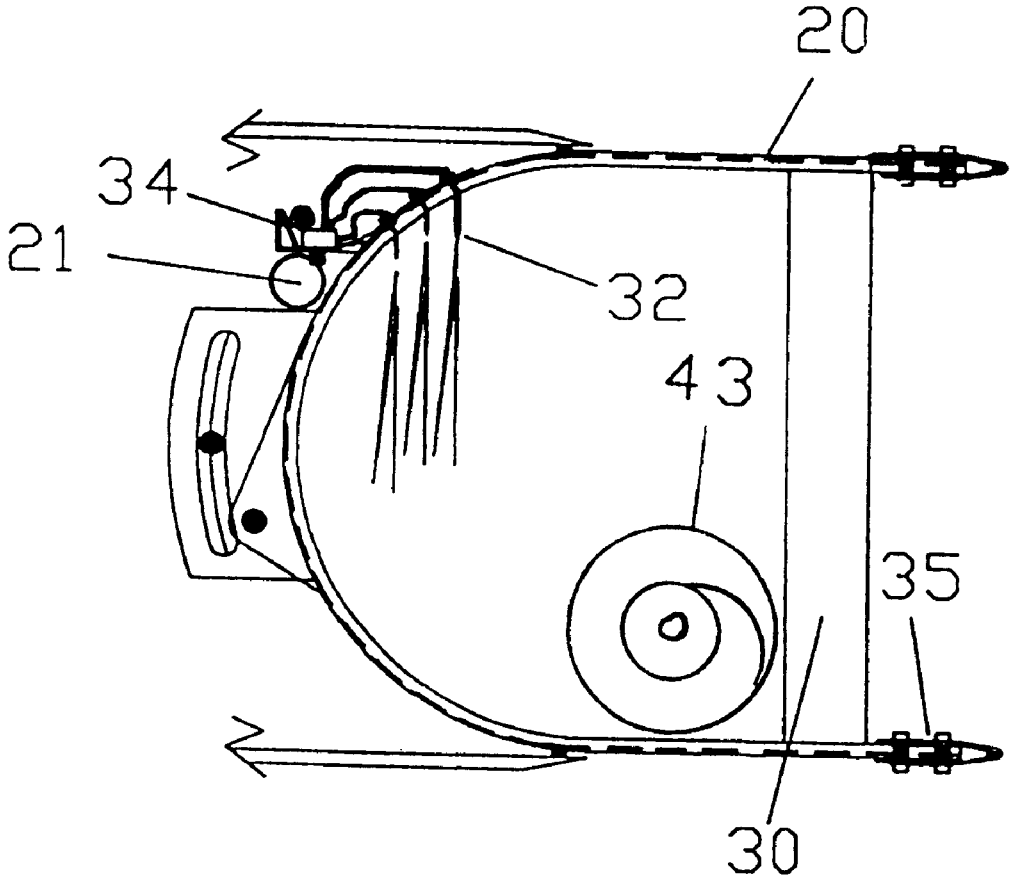
FIG. 4C shows an end view of the cutting head of a face sluicing chamber including an auger to promote removal of mined material.

The invention is based on the idea of removing the soft ore released at the face by slurrying it with pressurized water, but conventional conveying equipment, such as augers and chain conveyors, could be used as well either to evacuate or promote removal of slurried ore from the sluicing chamber. FIG. 4C illustrates such an auger 43 in combination with spray nozzles in the interior of the sluicing chamber 20.

Figure 5:
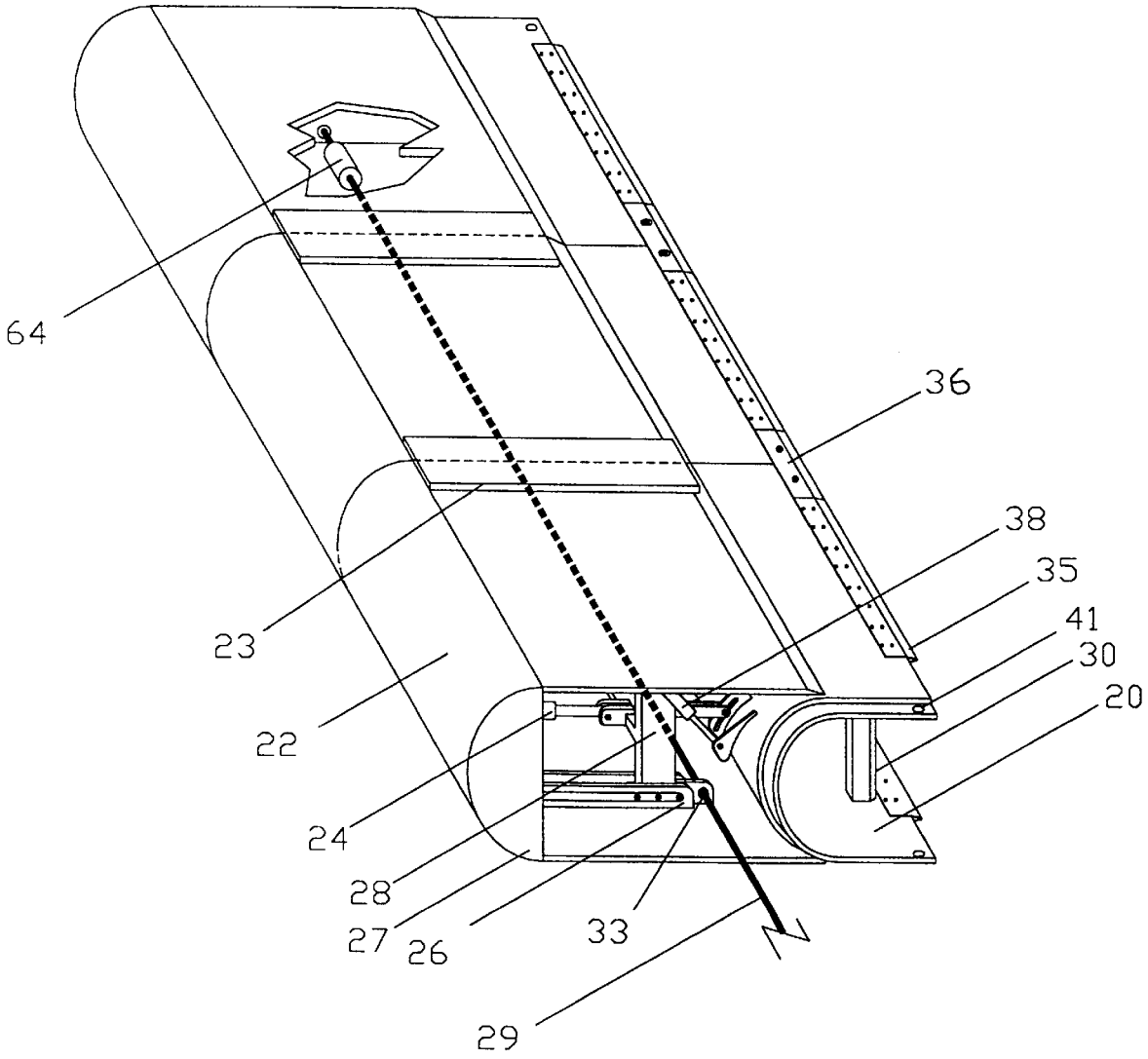
FIG. 5 shows a plurality of softwall mining devices according to the invention connected with a tensioning cable.

FIG. 5 shows in perspective view a plurality of softwall mining devices 10 connected with a softwall system control line 29 through the softwall system control line alignment holes 33. The softwall system control line 29 is secured with a constant tensioning device 64 flexibly attached to the most upstream device in the slurry flow. Adjoining devices 10 are provided with overlapping seals 23 and 36 to minimize leakage of foreign materials into the devices.

Figure 6:
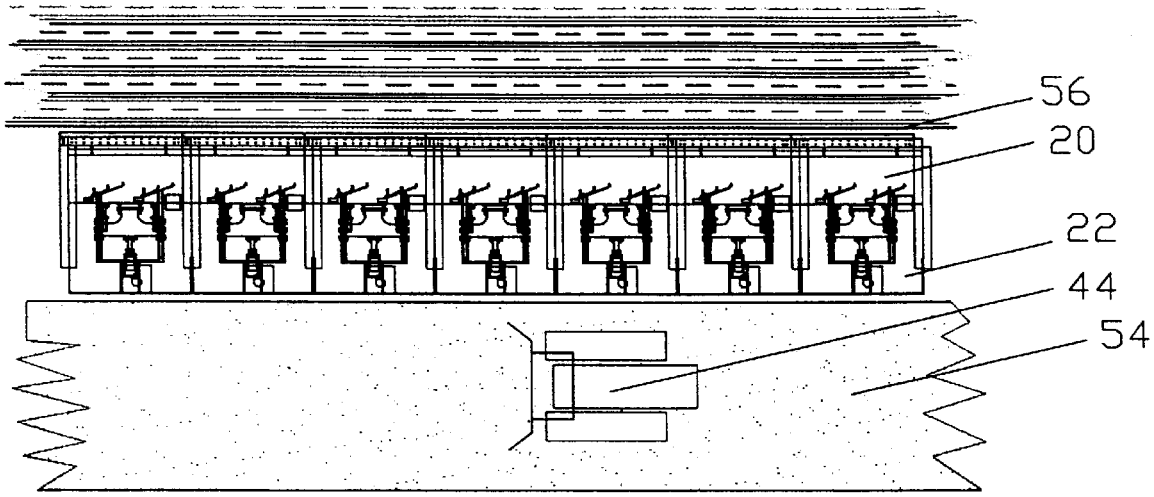
FIGS. 6, 7, and 8 show cooperative action of a plurality of softwall mining devices working together.
Figure 7:
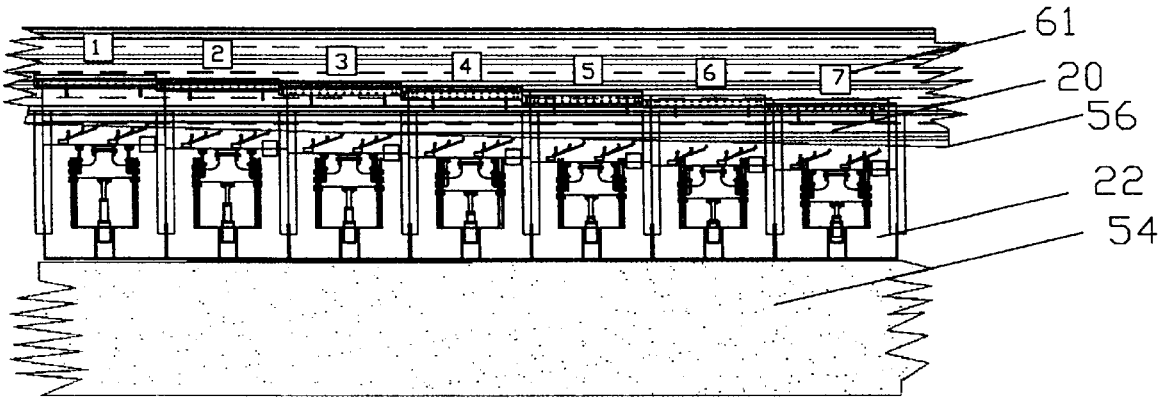
Figure 8:
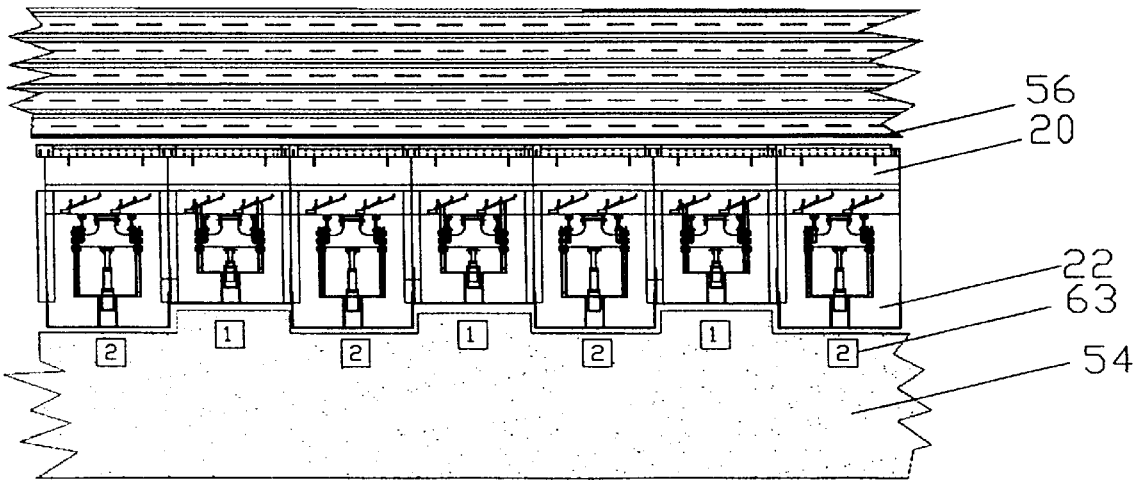

FIGS. 6 through 8 refer to the operation of the softwall mining devices 10 of the invention. There are a number of ways the devices of the invention can be operated. The following illustrations are not meant to be exhaustive but rather to illustrate only some of the possible ways and sequences in which they can be used to recover ore slurry material.

FIG. 6 is a schematic representation in plan view of the first step in the operation of the softwall mining devices 10. The devices are assembled along an ore matrix mining face 56 with full retraction of the face sluicing chambers 20 in preparation for an extension push into the ore matrix mining face 56 against a subsided earthy overburden 54. Surface compaction equipment 44 could be used on the surface for additional overburden compaction.

FIG. 7 is a schematic representation in plan view of a possible second step in the operation of the devices 10 showing an advance sequence of the face sluicing chamber 20 (illustrated by numerals 61) against the uniform alignment of adjacent rear bearing supports 22 bearing against the subsided earthy overburden 54. Prior to advancing into the mining face, the interior portions of the aligned chambers 20 form an open channel through which slurried material can flow. As each chamber is pushed against the mining face with its pressurized injection nozzles 32 operating at full flow, a portion of the channel is left open for communication with the adjacent chambers, so that the mined ore can flow downstream.

As a result of the extension of the face sluicing chambers 20 into the soft ore matrix, the top leading edges of the chambers penetrate into the ore body and support the overburden, which otherwise would fall in. This support relieves the ore contained within the chambers from the vertical ground pressure at the face. Under these conditions, the forward thrust of the sluicing chambers in combination with the fluidizing action of the pressurized injection fluid produces a volumetric displacement of the soft material in the chambers through the open channel in the downstream chambers and toward the open main trenches. This volumetric displacement and the hydraulic head produced by the injection nozzles enable the slurried ore to flow toward the main trenches even under unfavorable dip conditions of the ore seam. Nevertheless, as would be obvious to one skilled in the art, mining along a down dip is preferred to provide drainage of natural or mining waste water.

Thus, the forward thrust of the sluicing chambers of the invention, utilized in a judiciously selected sequence, produces a pumping action that enables the removal of the ore from the mining face. This approach constitutes a novel concept in mining and is particularly advantageous because it requires the kind of soft, wet and unstable ore conditions that normally render a seam unrecoverable by conventional means.

FIG. 8 is a schematic representation showing a third step in the operation of the softwall mining devices 10 in plan view. In this step, the support units of the rear bearing supports 22 are advanced (i.e., retracted toward the sluicing chambers) in a sequence illustrated, for example, by numerals 63 to show the direction of mining advance, thereby causing subsidence of the earthy overburden 54 behind the devices 10.

The three steps of the mining cycle illustrated above are repeated to provide uninterrupted mining and flow of ore from the mining face. These steps may be repeated either in the same direction or alternatively in opposite directions, if open main trenches are provided at both ends of the face. If necessary in order to create an open channel at the face, all chambers may need to be retracted a short distance from the face before a new push cycle is begun. For very long mining faces, the cycling of the steps will preferably occur in batches among groups of devices feeding multiple main entries at various points along the mining face such that all three steps are substantially contemporaneous at different positions along the face to secure its uniform advancement.

Figure 9:
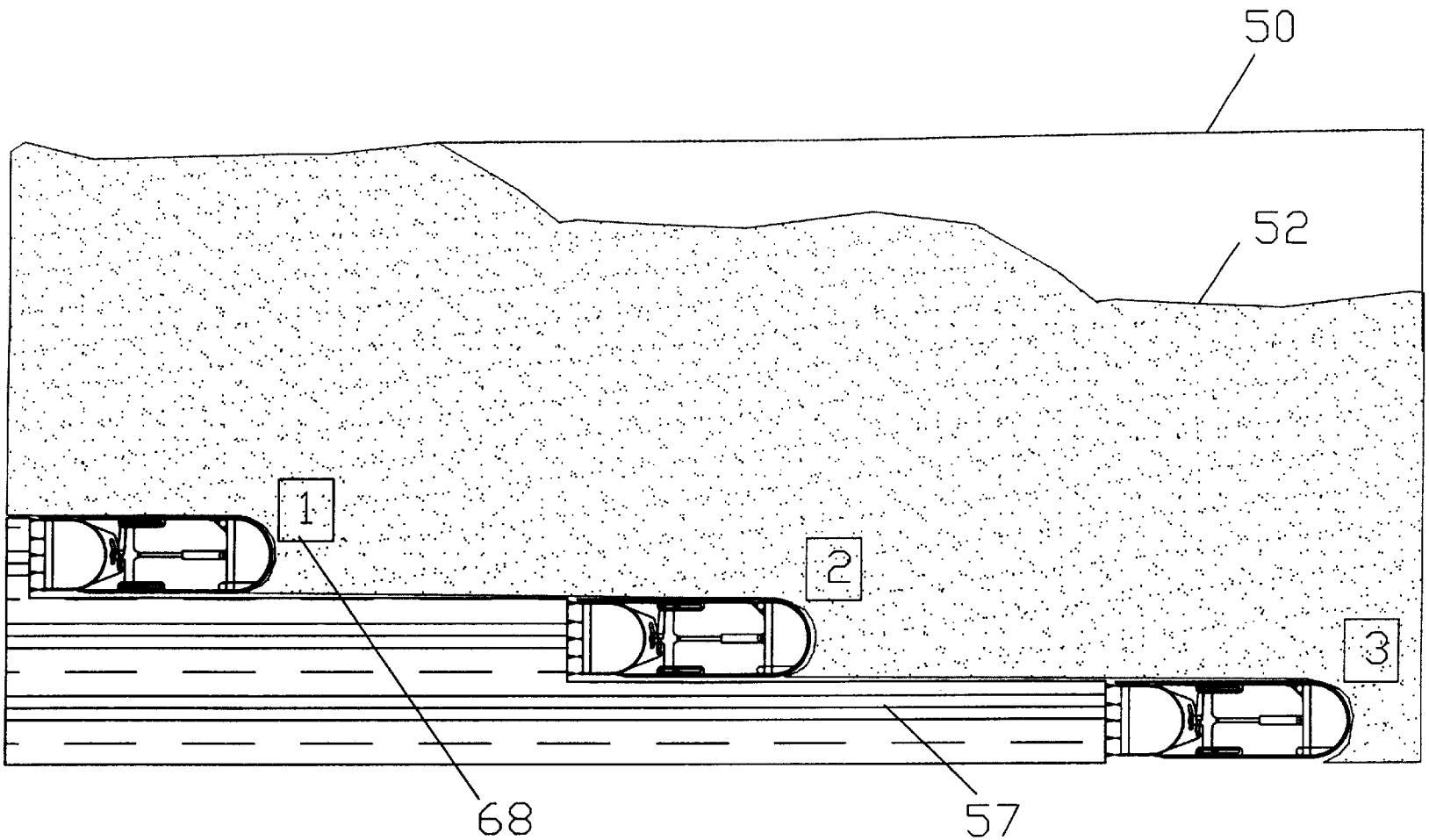
FIG. 9 shows employment of the softwall mining device of the invention in an ore body thicker than the device height.

FIG. 9 shows a multiple lift mining sequence 68 with a softwall mining device 10 or a set of devices in an ore body thicker than the device's height. The same device 10 or set of devices can be used to first mine the top layer of the ore seam and then relocated to mine additional lower layers as desired, the thickness of each layer being substantially equal to the height of the mining device. Alternatively, multiple devices or sets of devices may be arranged as seen in FIG. 9 to sequentially mine each layer downward from the top of the seam. This alternative could be carried out in alternative fashion by operating all sets of mining devices at the same time maintaining the relative position illustrated in the figure. Subsidence of the original overburden surface 50 will occur in stair-step fashion possibly producing a subsided surface 52 as the ore matrix 57 is removed.

Figure 10:
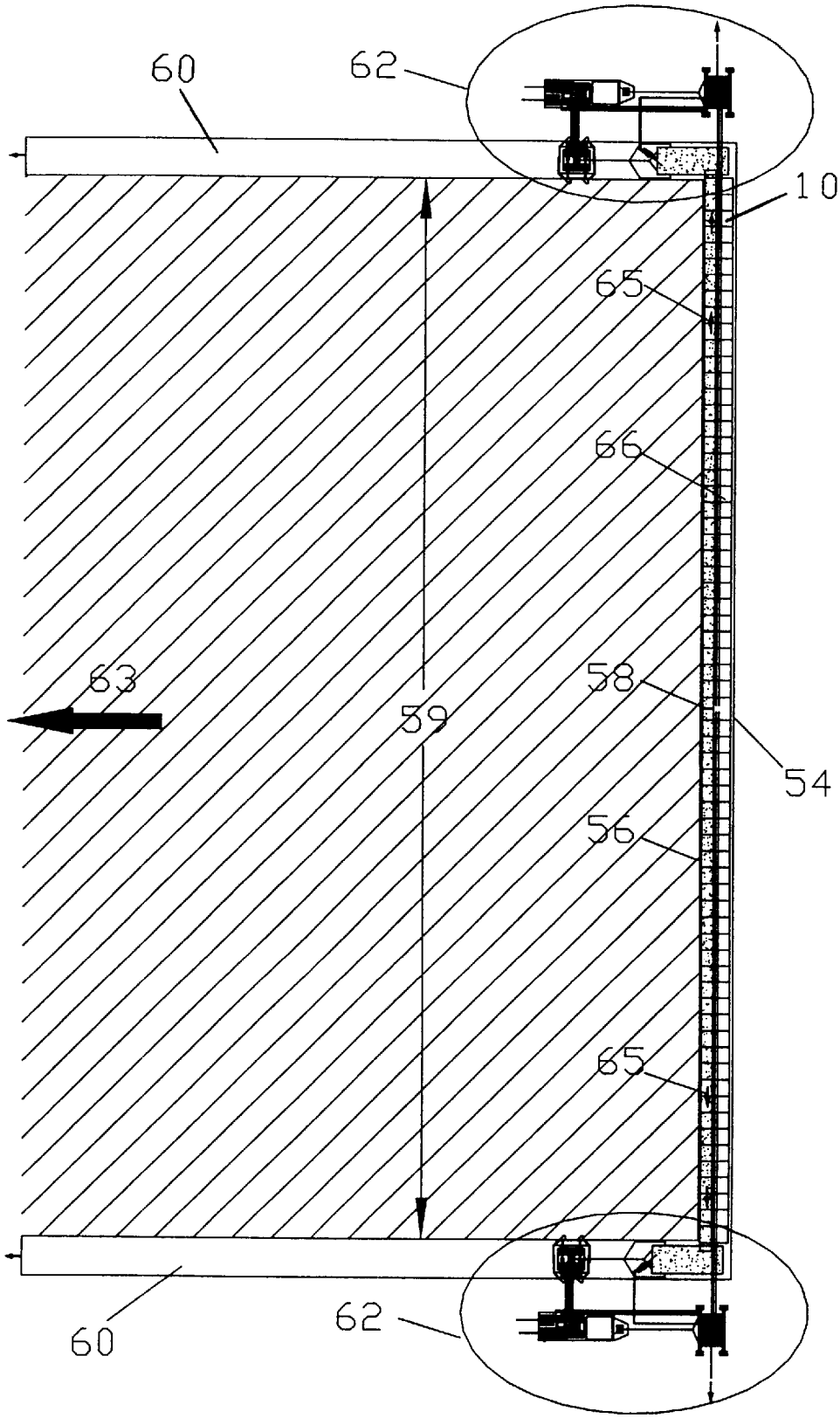
FIG. 10 shows the use of a plurality of the softwall mining devices of the invention with two parallel main trenches and a perpendicular header trench.

FIG. 10 illustrates the use of a plurality of softwall mining devices 10 with two parallel main trenches 60 and a perpendicular header trench 66 extending the full distance of the panel width 59. A plurality of adjacent softwall mining devices 10 progresses more or less parallel to the ore matrix mining face 56. A closed end 58 in a face sluicing chamber 20 in the middle of the face divides the header trench 66 forcing the slurried ore to follow the flow directions 65 toward the mains 60, where slurried ore is collected by trench-gate slurry handling equipment 62 placed at each main trench's end for transport and processing.

Figure 11:
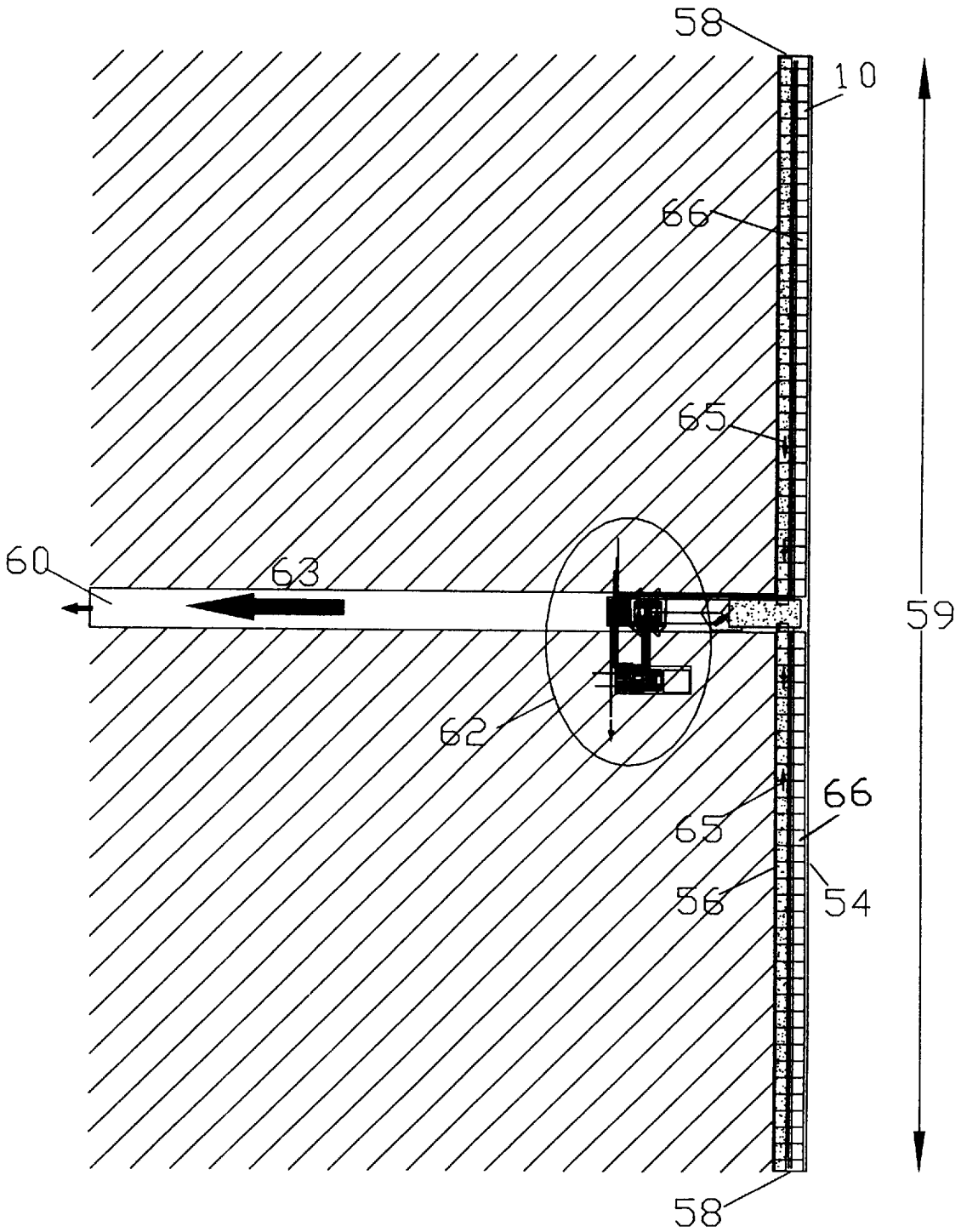
FIG. 11 shows a plurality of softwall mining devices used in an alternative "T" trench configuration.

FIG. 11 shows the use of a plurality of softwall mining devices 10 using an alternative "T" trench configuration with two header trenches 66 feeding into a single main trench 60 excavated during the mine development phase. Various changes in the details, steps and materials that have been described may be made by those skilled in the art within the principles and scope of the invention herein illustrated and defined in the appended claims. Therefore, while the present invention has been shown and described in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus and methods.

I claim:

1. A device for mining minerals comprising:

a weight-bearing housing having substantially-parallel, horizontal roof and floor panels integrally connected such as to define a horizontal channel-like shell;

a movable duct having substantially-parallel, horizontal top and bottom sections integrally connected such as to define a horizontal channel-like sluicing chamber with leading edges adapted for penetration into a seam of ore, said chamber being telescopically coupled to said shell and including means for mining ore; and means for extending and retracting said chamber relative to said shell.

2. A device for mining minerals as recited in claim 1, further comprising a means for injecting fluids from the leading edges of said chamber to enhance forward movement of said device.

3. A device for mining minerals as recited in claim 2, wherein said means for injecting fluids from the leading edges of said chamber include nozzles.

4. A device for mining minerals as recited in claim 2, wherein said means for mining ore includes a means for injecting fluids inside said chamber to slurry the ore.

5. A device for mining minerals as recited in claim 4, further comprising rear mounted injectors for dispensing materials into collapsing overburden.

6. A device for mining minerals as recited in claim 1, wherein said means for mining ore includes a means for injecting fluids inside said chamber to slurry the ore.

7. A device for mining minerals as recited in claim 6, wherein said means for injecting fluids inside said chamber to slurry the ore include angularly mounted nozzles.

8. A device for mining minerals as recited in claim 1, wherein said chamber contains an auger to promote evacuation of ore from said device.

9. A device for mining minerals as recited in claim 1, further comprising rear mounted injectors for dispensing materials into collapsing overburden.

10. A device for mining minerals as recited in claim 1, wherein said means for extending and retracting said chamber relative to said shell include hydraulic rams.

11. A device for mining minerals as recited in claim 1, wherein said roof and floor panels of the shell and said top and bottom sections the chamber are telescopically-engaged and said chamber has a substantially semicylindrical back portion.

12. A device for mining minerals as recited in claim 1, wherein said chamber's leading edges are substantially aligned with a front opening of the shell when the chamber is retracted, and the chamber's leading edges are projected outwardly with respect to the front opening of the shell when the chamber is extracted.

13. A method of mining minerals from a seam of slurryable ore located under earthy overburden comprising the following steps:

a) forming an elongated first trench of a first predetermined width to a depth substantially equal to the bottom of the seam;

b) forming a second elongated trench of a second predetermined width having one end at an end of said first trench to form a softwall face;

c) providing a plurality of softwall mining devices abutting a face of the seam in said second trench, each device comprising a weight-bearing housing having substantially-parallel, horizontal roof and floor panels integrally connected such as to define a horizontal channel-like shell; a movable duct having substantially-parallel, horizontal top and bottom sections integrally connected such as to define a horizontal channel-like sluicing chamber with leading edges adapted for penetration into a seam of ore, said chamber being telescopically coupled to said shell and including means for mining ore; and means for extending and retracting said chamber relative to said shell; and d) advancing said softwall mining devices in a direction generally perpendicular to said second trench to mine said seam by sequentially advancing the chambers of adjacent devices so as to produce a peristaltic compression of fluidized ore against the face of the seam.

14. A method according to claim 13, wherein mining is accomplished by advancing a plurality of sets of said softwall mining devices positioned at various overlapping elevations in the seam as follows:

i. arranging a first set of softwall mining devices to slurry ore from a top of the seam to a base of said first set of softwall mining devices;

ii. arranging a second set of softwall mining devices to slurry ore from the base of the first set of softwall mining devices to a base of the second set of softwall mining devices; and iii. arranging any additional set of softwall mining devices to slurry ore from a base of an immediately higher set of softwall mining devices to a base of said additional set, until the seam of ore is mined to a predetermined extent.

15. A method according to claim 13, wherein mining is accomplished as follows:

i. arranging a set of softwall mining devices to slurry ore from a top of said seam;

ii. proceeding with said set of softwall mining devices to a predetermined distance through said seam;

iii. relocating said set of softwall mining devices to a new top of said seam produced by step ii;

iv. proceeding with said set of softwall mining devices to a predetermined distance through said seam; and v. relocating said set of softwall mining devices to a new top of said seam produced by step iv;

vi. repeating steps iv and v until a predetermined amount of said seam has been removed.

16. A method according to claim 13, wherein mining is down dip to provide drainage of natural or mining waste water.

17. A method according to claim 13, wherein a third elongated trench is formed substantially parallel to said first trench and at the other end of said second trench not connected to said first trench to provide egress of slurried mined mineral into either or both of said first and third trenches.

18. A method according to claim 13, further comprising the step of providing rear-mounted injectors on said weight-bearing shell and dispensing fluid material therethrough into collapsing overburden.

19. A method according to claim 13, further comprising the step of injecting fluids from the leading edges of said chamber to enhance forward movement of said device.

20. A method according to claim 13, further comprising the step of injecting fluids inside said chamber to slurry ore.

21. A method according to claim 13, further comprising the step of providing an auger in said sluicing chamber to promote evacuation of slurried ore from said device.

22. A method according to claim 13, wherein the chamber's leading edges are substantially aligned with a front opening of the shell when the chamber is retracted, and the chamber's leading edges are projected outwardly with respect to the front opening of the shell when the chamber is extracted.

* * * * *